United States Patent [19]

Borca

[11] 4,318,634

[45] Mar. 9, 1982

[54] NON-VIBRATING COLLAPSIBLE DAM

[75] Inventor: Bruno Borca, Milan, Italy

[73] Assignee: PIRELLI/FURLANIS Applicasioni Idrauliche-agricole, Italy

[21] Appl. No.: 142,375

[22] Filed: Apr. 21, 1980

[30] Foreign Application Priority Data

May 10, 1979 [IT] Italy ..... 22510 A/79

[51] Int. Cl.[3] ..... E02B 7/02

[52] U.S. Cl. ..... 405/115

[58] Field of Search ..... 405/115

[56] References Cited

U.S. PATENT DOCUMENTS 495,788 4/1893 Debarle ..... 405/115

3,355,851 12/1967 Imbertson et al. ..... 405/115

3,834,167 9/1974 Tabor ..... 405/115

*Primary Examiner*—Ernest R. Purser

*Attorney, Agent, or Firm*—Stevens, Davis, Miller & Mosher

[57] ABSTRACT

A flexible collapsible dam for a watercourse is provided with one or more conduits for carrying water from upstream to downstream of the dam and thereby regulate the depth of water flowing over the dam to reduce vibrations of the dam caused by the water flowing over it. The water which is conveyed around the dam is discharged immediately downstream of the dam to prevent the deposit of objects on the bottom or banks of the watercourse where the collapsed dam contacts said bottom and banks.

4 Claims, 1 Drawing Figure

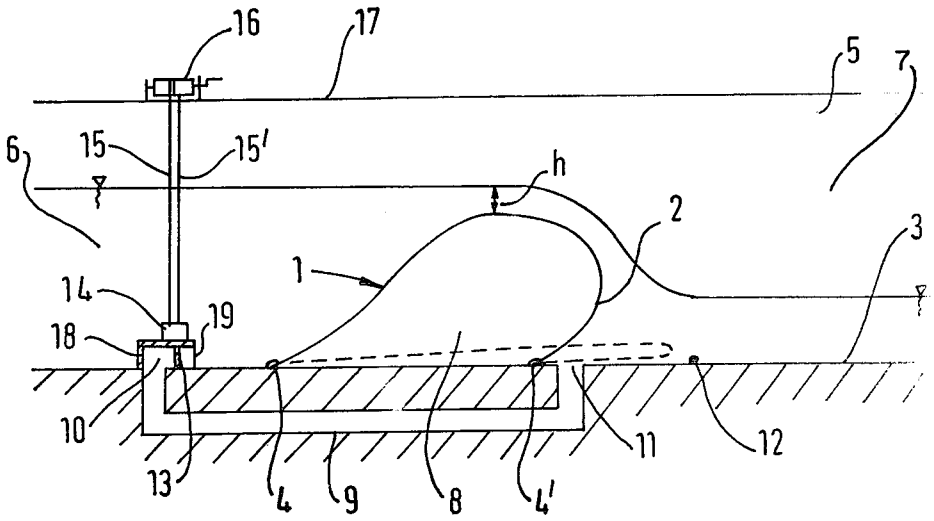
7
5
17
16
15'
15
6
3
h
2
1
19
14
18
12
11
4'
8
9
4
13
10

NON-VIBRATING COLLAPSIBLE DAM

This invention relates to a non-vibrating collapsible dam and, more particularly, to a collapsible dam of the inflatable type or of the open sheet type.

In the present invention, by inflatable dam is meant a collapsible dam having an enclosure of flexible, inextensible and waterproof material anchored in a fluid-tight manner to the bottom and to the walls of a watercourse where the dam is placed. The enclosure is provided with means for filling or emptying it with a fluid, generally the same water present in the watercourse, so as to create a transverse weir in the watercourse.

Always in describing the present invention, by open sheet dam is meant a collapsible dam constituted by a sheet of flexible, inextensible and waterproof material, a side of the sheet being anchored in a fluid-tight manner to the bottom and to the walls of the watercourse where the dam is placed. The opposite or upper side of the sheet is kept raised at a certain height from the bottom of the watercourse by conventional means such as ropes, chains or rigid rods to create a transverse weir in the watercourse.

In the collapsible dams, and in particular in the just described collapsible dams, vibrations in the dam can arise when the flow of water over the dam reaches a high level.

These vibrations arise in particular in the enclosure or in the sheet forming the dam when the depth of the water flowing over the upper lip of the dam exceeds a certain value, depending on the dam type, its dimensions, the material and type of the enclosure or sheet and generally on the constructive characteristics of the dam.

These vibrations produce stresses which can damage the dam both within a short time and in the long run which tend to reduce the useful life of the dam.

An object of the present invention is to prevent vibrations in the enclosure or in the sheet of the dam.

Another object of the invention is to prevent deposit of objects or materials floating on the water which flows over the upper lip of the collapsible dam on the bottom or against the walls of the watercourse where they interfere when the dam is collapsed.

Still another object of the invention is to provide a dam for a flowing watercourse such as a river, stream or the like which has a collapsible wall-like member extending substantially across the width of the watercourse and upwardly from the bottom of the watercourse which does not vibrate as water flows thereover and does not cause objects floating on the water as they flow over the dam to deposit near the dam itself.

Other objects of the invention will become apparent from the following description with reference to the accompanying drawing wherein one embodiment of the collapsible dam of the invention is illustrated diagrammatically in cross-section.

The foregoing objects and others are accomplished in accordance with this invention, generally speaking, by providing a collapsible dam having a web or strip of flexible, inextensible and water repelling material stretched across the width of a watercourse and secured to the bottom and side banks of the watercourse to obstruct flow of water in the watercourse, a by-pass for flow of water from upstream to downstream of the transverse flexible flow obstructing member and a means for regulating the flow of water through the by-pass. In a preferred embodiment of the invention, the by-pass conduit empties into the watercourse substantially downstream of the dam to prevent turbulence and prevent objects floating over the dam from settling to and accumulating on the bottom of the dam where they might interfere with the collapse of the dam on the bottom of the watercourse. The by-pass may extend in the soil forming the bottom of the watercourse or it may extend around the ends of the dam in one or both of the sidebanks of the watercourse.

In other words, the present invention provides a collapsible dam characterized by the fact of comprising at least one water passage present in the bed of the watercourse, which draws water from upstream of the dam and discharges it downstream of the dam, the water passage being provided with means for closing, opening and regulating the flow of water passing therethrough.

Referring now to the drawing, a non-vibrating collapsible dam 1 of the type having an enclosure or water obstructing transverse member 2 of flexible, inextensible and waterproof rubberized fabric is anchored in a fluid-tight manner to the bottom 3 of the watercourse by two or more elongated clamps 4 and 4' aligned on two parallel lines.

The enclosure 2 is secured similarly in a fluid-tight manner to the lateral walls 5 (only one is shown) of the watercourse. Therefore, the enclosure 2 is arranged transverse of the watercourse and, in particular, divides the watercourse into two basins, the upstream basin 6 and the downstream basin 7. In order to obtain this, the cavity 8 formed between clamps 4 and 4' of the enclosure 2 is filled with water from the stream or river by directing the flowing water therein or by a pump or other means.

The means for filling enclosed cavity 8 of member 2 can also be used for emptying the enclosure 2 when it is desired to collapse the dam 1.

The position and the shape that the enclosure 2 assumes when the dam 1 is collapsed are shown in the drawing with a dotted line.

In the most general concept of the invention, a non-vibrating collapsible dam comprises, as an essential feature, at least one water passage, disposed in the bed or one or both of the lateral walls of the watercourse. The water passage withdraws water from upstream of the dam and discharges it downstream of the dam, the water passage being provided with means for opening and closing it and for regulating the flow of water passing therethrough.

In the particular embodiment shown in the drawing, the water passage is a conduit 9 placed on the bottom 3 of the watercourse under the dam 1. Conduit 9 is provided with a water intake end 10 in the upstream basin 6 of the dam 1 and with at least one outlet opening 11 in the downstream basin 7 of the dam 1.

Outlet opening 11 of the conduit 9 is placed immediately downstream of the dam 1 and preferably in the zone of the bottom 3 and/or of the lateral walls 5 of the watercourse where the enclosure 2, when the dam 1 is collapsed, contacts the bottom 3 or lateral walls 5 of the watercourse. This zone starts immediately downstream of the line where clamps 4' are aligned and extends downstream as far as the enclosure 2 can reach when the dam 1 is completely collapsed and i.e. an ideal line 12 (only one point of the line 12 can be seen in the drawing) lying on the bottom 3 and on the lateral walls 5 of the watercourse.

Conduit 9 is provided with conventional closing and opening means i.e. means for allowing or preventing the passage of water from the upstream basin 6 to the downstream basin 7 of the dam 1. The closing and opening means also regulate the water flow passing through the conduit 9.

The closing and opening means are, in the embodiment shown in the drawing, a gate valve 13 provided with a conventional driving device 14, moved by two ropes 15 and 15' wound on a winch 16 fixed on one of the sides 17 of the watercourse.

Gate valve 13 is placed in a seat 18 where it is easily accessible for the usual maintenance.

Preferably, a filter and/or a mesh 19 is placed at the opening of the seat 18 where the water flowing into conduit 9 enters to prevent the entrance of objects or debris transported by the water into conduit 9.

A filter or a mesh similar to the mesh 19 can be placed also on the outlet opening 11 of the conduit 9.

Instead of a conduit 9, in an alternative embodiment of the invention not shown in the drawing, the water passage between the upstream basin 6 and the downstream basin 7 of the dam 1 can be more than one conduit similar to conduit 9, each of the conduits 9 being provided with means for opening and closing it and for regulating the flow of water through each conduit.

Moreover, some of the conduits, or all of the conduits, can be placed in the lateral walls 5 of the watercourse with their outlet openings in the zone immediately downstream of the dam 1.

Alternative to the presence of more than one conduit, a single opening provided with means for its opening and its closing and for regulating the water passing through it can be placed on the bottom 3 or also partially in the lateral walls 5 of the watercourse, the opening having a nearly rectangular shape in perpendicular cross-section to the water flow passing through it. Furthermore, the outlet opening 11 of the conduit or conduits 9 can be provided with fixed nozzles which are fixed or adjustable from a distance to direct water flowing out of the conduit into the most suitable direction or directions.

The operation of the non-vibrating collapsible dam 1 according to the present invention is as follows.

Acting appropriately on the winch 16, the two ropes 15 and 15' are, respectively, one wound and the other unwound from winch 16 supposing that the gate valve 13 is lowered and it is desired to raise it, the device 14 moved by two ropes 15 and 15' raises gate valve 13 making a part of the water in the upstream basin 6 pass inside the conduit 9. By raising or lowering gate valve 13 the water flowing through conduit 9 is regulated. Then, wishing to close conduit 9, it is sufficient to act in the contrary direction on the winch 16 so that the ropes 15 and 15', respectively unwinding and winding on winch 16, will move the device 14 in such a way as to lower the gate valve.

The water which arrives in the upstream basin 6, in the conditions represented in the drawing, passes over the upper edge of the dam 1 and enters into the downstream basin 7. The depth h of the water flowing over dam 1 has a critical value above which the enclosure 2 begins to vibrate.

This critical value depends on the type of collapsible dam, its dimensions and other elements which prevent the unequivocal definition of the height h, above which each single dam begins to vibrate.

These vibrations obviously are harmful both for the material constituting the enclosure 2 and for the structure of the dam 1. In order to reduce the height h in the case of increase in the water flow, a greater volume of water is admitted into the cavity 8 of the enclosure 2 to increase the height of the dam. But, this solution increases also the level in the upstream basin 6, which can be an undesirable consequence, and cannot be practiced to resolve large increases in the water flow or for compensating for increases over very long periods of time. In fact, the maximum height of the dam 1 is limited either by the dimensions of the sheet constituting the enclosure 2 or by the height of the sides or banks 17 of the watercourse taken from the bottom 3 of the watercourse.

Consequently, the regulation of the height h defined before with this system is very limited both in quantity and in time.

Instead, with the presence of the water passage between the upstream basin 6 and the downstream basin 7, in particular with the presence of the conduit or conduits 9 present in the bottom 3 and/or in the lateral walls 5 of the watercourse, any increase in the water flow can be made to pass beyond the dam 1 without having the height h exceed the critical value.

In fact, summing the water flow passing over the upper lip of the dam 1 and giving rise to the height h to the water flow passing through the conduit 9, it is possible to obtain a water flow equal to the water flow upstream of dam 1 thereby avoiding at the same time height h reaching or exceeding the critical value where the dam begins to vibrate.

By providing the outlet opening 11 of the conduit 9 in the previously defined zone immediately downstream of the dam 1, another effect besides that previously mentioned, is obtained. In fact, the water flowing over the upper edge of the dam 1 when flowing into the downstream basin 7 creates, in the portion immediately downstream of the dam 1 of basin 7, a zone of high turbulence which facilitates deposition of these objects or rubble in this zone. The presence of outlet openings 11 instead prevents these objects or rubble from depositing since they are driven beyond line 12 by the flow of water emerging from said outlet openings.

Moreover, the water flowing out of the outlet opening or openings 11 avoids the eddy caused by the high turbulence existing in the downstream basin 7 in the portion adjacent to the dam 1. This eddy further stresses the structure of the enclosure 2 and is eliminated by the flow coming out of the conduits 9 since the depression caused by the eddy is "filled" with the water flowing out of the outlet openings 11.

The determination of the volume of the water by-pass connecting the upstream basin 6 with the downstream basin 7 is a function of the maximum flow of water in the watercourse where the dam is disposed and can be determined.

By means of the non-vibrating collapsible dam of the present invention the pre-fixed purposes can be achieved. In fact, the presence of the water passage or passages connecting the upstream basin with the downstream basin eliminate the possibility that vibrations arise in the enclosure or water obstructing member forming the dam.

In fact, by preventing the above defined height h from exceeding a predetermined value with the expedient of discharging the water below the dam in association with the expedient of making the water falling from above the dam meet with that flowing under the dam, probably keeps the forming whirlpools from originating vibrations in the enclosure of the dam since the whirlpools are rapidly detached from the dam.

Furthermore, the deposit of rubble or the accumulation of objects of various materials is prevented in the zone where the enclosure of the dam contacts the bottom or the lateral walls of the watercourse when the dam is collapsed.

The present invention has been described as a non-vibrating collapsible dam of the inflatable type, but it is understood that the present invention can be applied to any type of collapsible dam and in particular also to a collapsible dam of the open sheet type.

Although some particular embodiments of a non-vibrating collapsible dam according to the present invention have been illustrated and described, it is understood that the invention can be varied by those skilled in the art without departing from the spirit and scope of the invention except as it may be limited by the claims.

What is claimed is:

1. A collapsible dam installed across a watercourse having a bottom and side banks, said dam comprising a flexible, elongated water obstructing member having spaced longitudinally extending edges and laterally spaced ends disposed across the watercourse and anchored at each end to said side banks, first and second means anchoring both of said longitudinally extending edges to the bottom of the watercourse with the second means spaced downstream from the first means, said water obstructing member being buoyed upwardly towards the surface of the water between the said anchoring means to obstruct flow of water in the watercourse, and a water by-pass means for flow of water around the said water obstructing member for regulating the depth of water flowing over the water obstructing member to reduce vibration of the said obstructing member, said water by-pass means comprising a conduit having a water intake disposed upstream of the water obstructing member and a water outlet disposed downstream of the water obstructing member where water flowing from the outlet will flow upwardly against the water obstructing member while it is buoyed upwardly from the bottom of the watercourse, and means for regulating water flow in the conduit.

2. A collapsible dam installed across a watercourse comprising a flexible inextensible fluid impervious sheet having opposite edges placed transversally of the watercourse and fixed thereto by first and second spaced anchoring means along two parallel lines, said second means being downstream of said first means to form an inflatable enclosure defining an upstream and a downstream basin with respect to said dam, said enclosure having opposite ends extending over and fixed to the banks of said watercourse, said enclosure, when collapsed, extending in contact thereto along an area of the bottom and banks of said watercourse downstream of said second anchoring means, at least one conduit, provided with regulating means, having an intake in said upstream basin and an outlet in said downstream basin, said outlet being placed, with respect to said enclosure, within the area of the banks and bottom of the watercourse contacted by the enclosure when collapsed, whereby, by regulating the flow of water within said conduit, the water flowing above the inflated enclosure is contained below a critical level thereby preventing vibration in the sheet forming said enclosure.

3. The collapsible dam of claim 2 wherein the said conduit has an outlet opening placed immediately downstream of the dam.

4. The collapsible dam of claim 2 wherein the said outlet opening is placed in the bottom or in a lateral wall of the watercourse within the zone where the dam, when it is in the collapsed condition, contacts the bottom and the walls of the watercourse.

* * * * *